United States Patent [19]

Kuroda

[11] Patent Number: 4,914,351

[45] Date of Patent: Apr. 3, 1990

[54] ELECTRON MULTIPLIER DEVICE HAVING ELECTRIC FIELD LOCALIZATION

[75] Inventor: Kei-Ichi Kuroda, Geneva, Switzerland

[73] Assignee: Agence Nationale de Valorisation de la Recherche (Anvar), Paris, France

[21] Appl. No.: 731,860

[22] Filed: May 8, 1985

[30] Foreign Application Priority Data

May 9, 1984 [FR] France ..... 84 07142

[51] Int. Cl.[4] ..... H01J 29/41

[52] U.S. Cl. ..... 315/12.1; 313/105 R; 313/105 CM

[58] Field of Search ..... 315/12.1; 313/105 R, 313/105 CM, 104

[56] References Cited

U.S. PATENT DOCUMENTS 3,579,017 5/1971 Vestal .

4,649,268 3/1987 Persyk ..... 313/105 R

FOREIGN PATENT DOCUMENTS 0013235 12/1978 European Pat. Off. .

OTHER PUBLICATIONS

Review of Scientific Instruments, vol. 52, No. 3, Mar. 1981, pp. 337–346, New York, U.S.A., Kuroda, "New Type of Position Sensitive Photomultiplier".

*Primary Examiner*—Theodore M. Blum

*Attorney, Agent, or Firm*—Thomas J. Greer, Jr.

[57] ABSTRACT

Photomultiplier dynodes ($D_1$, $D_2$ . . . ) each comprise two spaced planes ($D_{11}$ and $D_{12}$) made up elementary laminations having a cross-section in the form of an isosceles triangle which is symmetrically disposed relative to the inlet window of the photomultiplier tube. The laminations in the two consecutive planes of a single dynode stage are offset relative to each other to constitute a baffle, and are disposed in such a manner that electrons leaving the first plane pass through the second plane without striking the laminations thereof. The distance $Z_1$ between two dynode stages is large relative to the distance $Z_O$ between the two planes of a single dynode, and is chosen as a function of the electric field in such a manner that the secondary electrons from the upstream stage strike a limited number of the laminations in the downstream stage with a concentrated distribution.

14 Claims, 4 Drawing Sheets

ELECTRON MULTIPLIER DEVICE HAVING ELECTRIC FIELD LOCALIZATION

The invention relates to electron multiplier devices, and more particularly to photomultiplier tubes.

BACKGROUND OF THE INVENTION

French patent specification No. 2 445 018 (or U.S. Pat. No. 4,339,684), describes an electron multiplier tube capable of "localization". In such a tube the center of distribution of the secondary electrons on the outlet anode corresponds, to some extent, on the position of the point of impact of the radiation to be amplified on the inlet window to the tube. The word "radiation" is used in a broad sense here since it may refer to photons or to electrons or to other charged particles capable of causing secondary electrons to be extracted. This previously-described electron multiplier gives complete satisfaction, in particular in relation to the spatial resolution it achieves. However, to do this it superposes a magnetic field on the accelerating electric field which the device must have in any case. The means required for providing the magnetic field tend to complicate the structure of the electron multiplier device, and also to increase the cost. Further, by virtue of the space they occupy, these magnetic means also tend to reduce the space available for electron multiplication, and thus the size of the inlet window to the device and/or access thereto.

Thus, as is seen below, the object of the present invention is to solve the problem consisting in providing an electron multiplier device capable of localization but which operates without a superposed magnetic field, while still obtaining localization properties which are comparable to or at least nearly comparable to those obtained by means of combined electric and magnetic fields in the prior art.

SUMMARY OF THE INVENTION

The present invention provides an electron multiplier device which comprises, in a vacuum tube, a succession of plane parallel electrodes defining a plurality of dynode stages capable of secondary electron emission between an inlet window and an outlet anode, and means connected to said electrodes in order to establish therebetween an electron accelerating field whose general direction is perpendicular to the electrodes.

Further, the proposed electron multiplier device is structurally similar in several respects to the prior art device using a magnetic field: in both cases each dynode stage is defined by two successive planes, each constituted by interconnected parallel laminations, and these laminations are offset relative to each other in pairs such that a pair of laminations together define a baffle or chicane obstacle to electron trajectories perpendicular to the laminations. It is important to observe that in spite of this structural similarity, the operation of the two devices is not at all the same, since the electron trajectories obtained by using both an electric field and a magnetic field are totally different from the trajectories which are obtained using an electric field only. When using only an electric field, localization is essentially defined by the lateral path of secondary electrons due to the transverse component of the initial speed. The present invention uses an appropriate geometrical structure for the dynodes to solve the problem of achieving a compromise between gain and spatial resolution, which impose opposite constraints on the lateral path parameter. This thus constitutes a first feature of the invention.

Additionally, the invention also provides for each dynode stage to be arranged so that the majority of the secondary electrons effectively leaving a first plane lamination do not collide with a second plane lamination, while the distance between two successive dynode stages which is large relative to the distance between the two planes of a single stage is so chosen as a function of the electric field that the secondary electrons from an upstream stage strike a restricted number of laminations in the downstream stage by virtue of a concentrated distribution.

The expression "effectively" leaving a lamination from a given plane of laminations is used herein to take account of the fact that a secondary electron may be recaptured either by the lamination from which it originated or by another lamination in the same plane.

In accordance with another feature of the invention, the laminations which are prismatic or cylindrical have a cross-section which projects towards the inlet window with two flanks capable of secondary emission on either side of said projection, said flanks being disposed substantially symmetrically relative to the general direction of the electric field; the distance between dynode stages is chosen in such a manner that secondary electrons coming from an upstream stage strike the flanks of the laminations in the downstream stage in a substantially balanced manner, said flanks having symmetrical inclinations thereby avoiding any systematic drift in the localization.

In a particular embodiment, which is currently the preferred embodiment, the cross-section of the laminations is substantially in the form of an isosceles triangle with the two equal angles lying in the range of about 40° to about 70°. The triangle may naturally be a curvilinear triangle, or its sides may be deformed in some other manner given the machining tolerances applicable to manufacturing devices of the size of the laminations.

According to another particular feature of the invention, the majority of the secondary electrons from a given flank of a lamination in an upstream stage strike only two adjacent laminations in the first plane of the following downstream stage, and one lamination of the second plane of said following downstream stage.

Advantageously, the distance between consecutive dynode stages is chosen so as to slightly unbalance the symmetry of impact on the downstream stage of the secondary electrons thus generated by an upstream stage in order to avoid a shift in the spatial localization due to the inclination of the flanks.

Although these parameters may depend on the particular embodiment concerned, it is currently considered that:

the distance between consecutive dynode stages should be about eight to ten times the apparent width of the laminations;

the distance between the two planes of a single dynode stage should be about one-fourth of the distance between two consecutive dynode stages;

the apparent width (substantially the overall width) of the laminations should be no greater than about 0.5 mm;

the average electric field inside the electron tube should be not less than about 500 volts/centimeter; and the initial energy of the secondary electrons which are effectively emitted is preferably not less than about 5 electron-volts, and may be several tens of electron-volts.

All the laminations in the tube may be parallel, but the localization properties may also be improved by orienting the laminations in different directions in different dynode stages in a regular manner. The simplest manner is to have the laminations of one dynode stage perpendicular to the laminations of the preceding stage.

The invention also provides good detection of an isolated photoelectron (or an isolated incident charged particle). For this purpose, the electric voltage between the two planes of a single stage of dynodes may be as much as about 50 volts, at least for the first dynode stages.

According to yet another feature of the invention, means may be provided to adjust the voltage feed to the electrodes so as to optimize the spatial resolution of the electron multiplier device.

Depending on the intended application, the electron multiplier device may include a cathode or a photocathode in the proximity of the first dynode.

Although a conventional anode is adequate in some cases, the device preferably includes a multiple connection divided anode, an electroluminescent surface, a resistive anode, or any other equivalent means enabling the localization property to be used.

BRIEF DESCRIPTION OF THE DRAWINGS

An embodiment of the invention is described by way of example with reference to the accompanying drawings, in which.

MORE DETAILED DESCRIPTION

In the present invention the geometry of the main components of the electron multiplier tube is important. Consequently, the drawings are to be considered as being incorporated in the present description to contribute, where appropriate, to ensuring that the description is complete and also contribute to defining the invention.

The following detailed description relates to a photomultiplier tube. In such a tube the incident signal is delivered by photons which may excite the dynodes of an electron multiplier either directly or else via a photocathode. However, the present invention is also applicable to sources other than photons, e.g. to electrons per se or other types of charged particle capable of defining an inlet signal to an electron multiplier tube.

Figure 1:
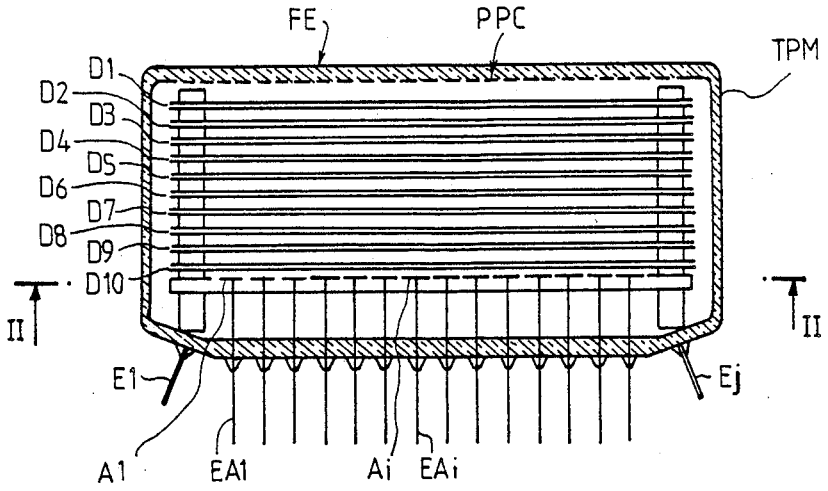
FIG. 1 is a vertical section through a photomultiplier in accordance with the invention.
Figure 2:
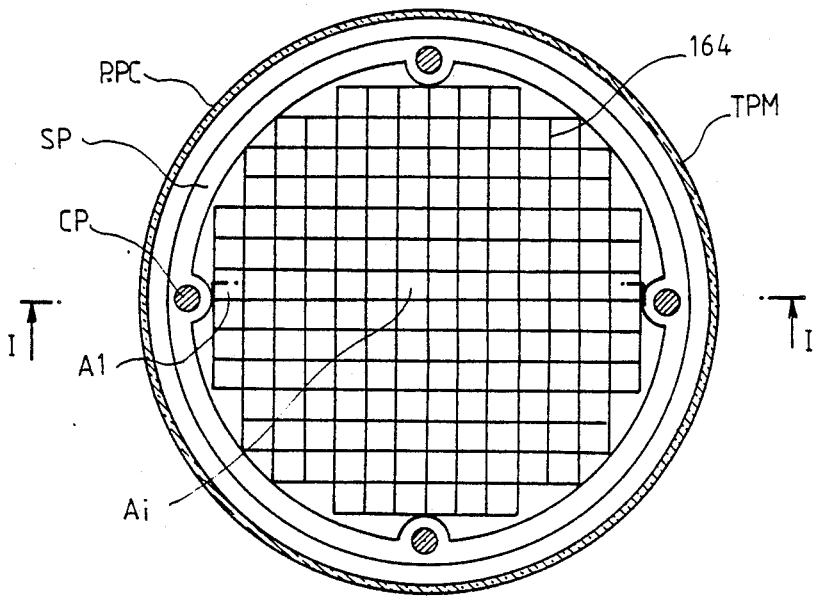
FIG. 2 is a horizontal section through the FIG. 1 photomultiplier.

In FIGS. 1 and 2, the photomultiplier tube comprises a vacuum chamber TPM in which the main components are housed. FIG. 1 shows that this chamber includes an inlet window FE at the top thereof. Just behind this window there is a proximity photocathode marked PPC. Beneath the photocathode PPC (see FIG. 1) there are ten dynode stages $D_1$ to $D_{10}$. Still further down, there is an anode which is divided into a "mosaic". This anode comprises a large number of elements such as $A_1$ and $A_i$, which are respectively connected to individual electrical output connections $EA_1$ and $EA_i$. The anode assembly is noted $A_n$. Finally, other electrical connections such $E_1$ and $E_j$ serve to raise the internal electrodes of the photomultiplier to suitable potentials for its operation.

FIG. 2 also shows the generally circular shape of the support structure SP which supports the dynodes. This structure is fitted with insulating support columns such as CP.

Figure 3:
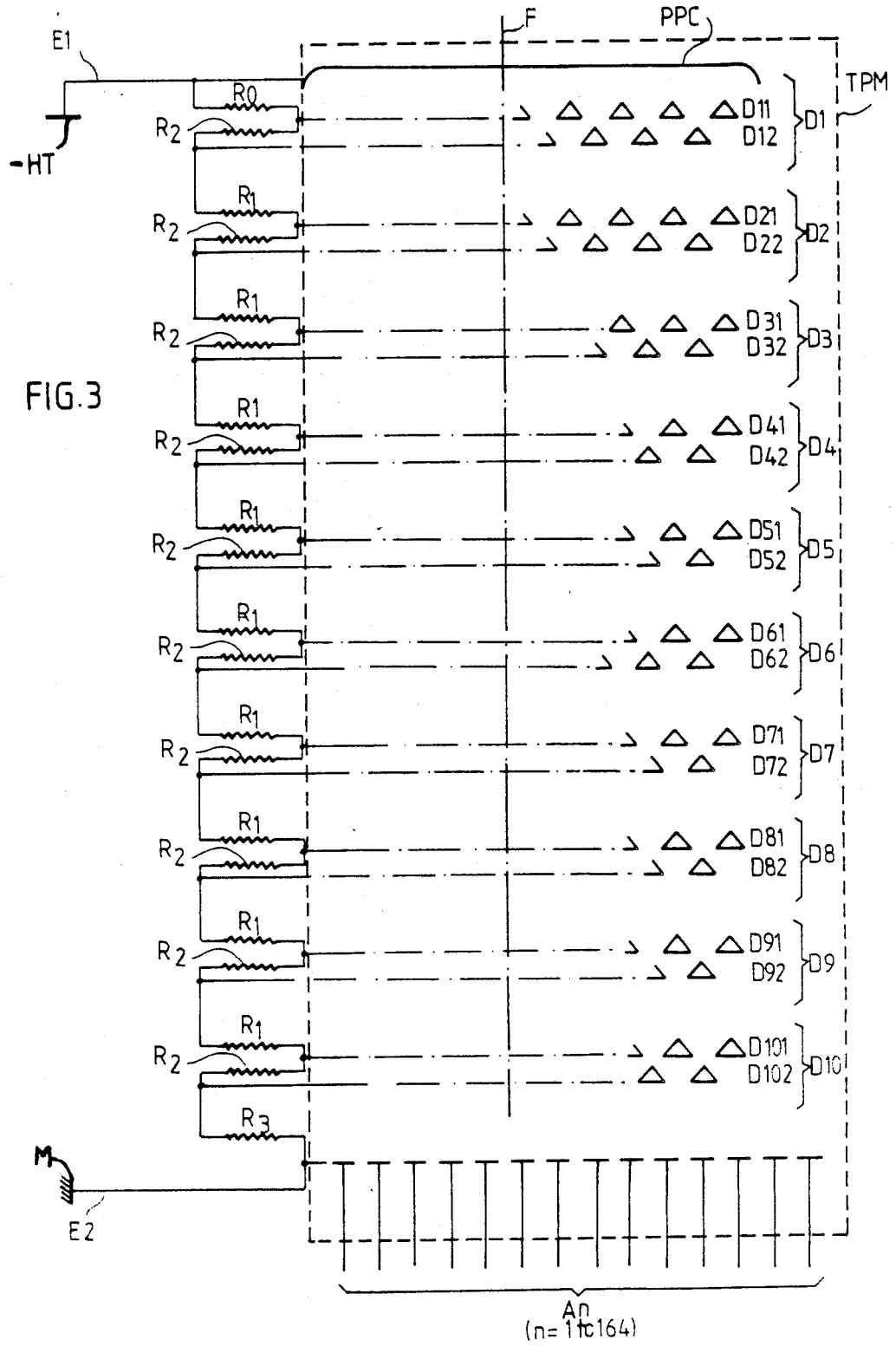
FIG. 3 is an electrical circuit diagram showing how the electrodes in a given photomultiplier are interconnected.

FIG. 3 is an electrical circuit diagram associated with the photomultiplier, and the enclosure TPM is indicated by a dashed line. It can be seen that each dynode stage such as $D_1$ comprises, in accordance with the invention, two levels or planes of electrodes such as $D_{11}$ and $D_{12}$, which are placed one behind the other along the axis F of the electrical field of the tube and which extend perpendicularly to said axis.

The proximity photocathode PPC is connected to a voltage - HT via the electrical connection $E_1$. At the other end, the electrical connection $E_2$ is connected to ground. A voltage divider network made up of resistances is connected between the lines $E_2$ and $E_1$ so as to apply an appropriate electrical voltage to each of the dynode planes. The supply high tension serves to define a potential difference and thus an electric field between the various planes of dynodes. The resistances are selected so that the electric field is as uniform as possible.

In practice, and ignoring the end resistances $R_0$ and $R_3$, a resistance $R_1$ is provided between the first plane of each dynode (for example the plane $D_{21}$ of the dynode $D_2$) and the last plane of the preceding dynode (in thise case the plane $D_{12}$ of the dynode $D_1$). A smaller resistance $R_2$ is provided between the two planes of each dynode stage (for example between the planes $D_{21}$ and $D_{22}$ of the dynode $D_2$). It may be necessary to add capacitances at certain points along this series resistive network, in particular to the last stages. The anodes $A_n$ are connected to ground via individual resistances.

Figure 4:
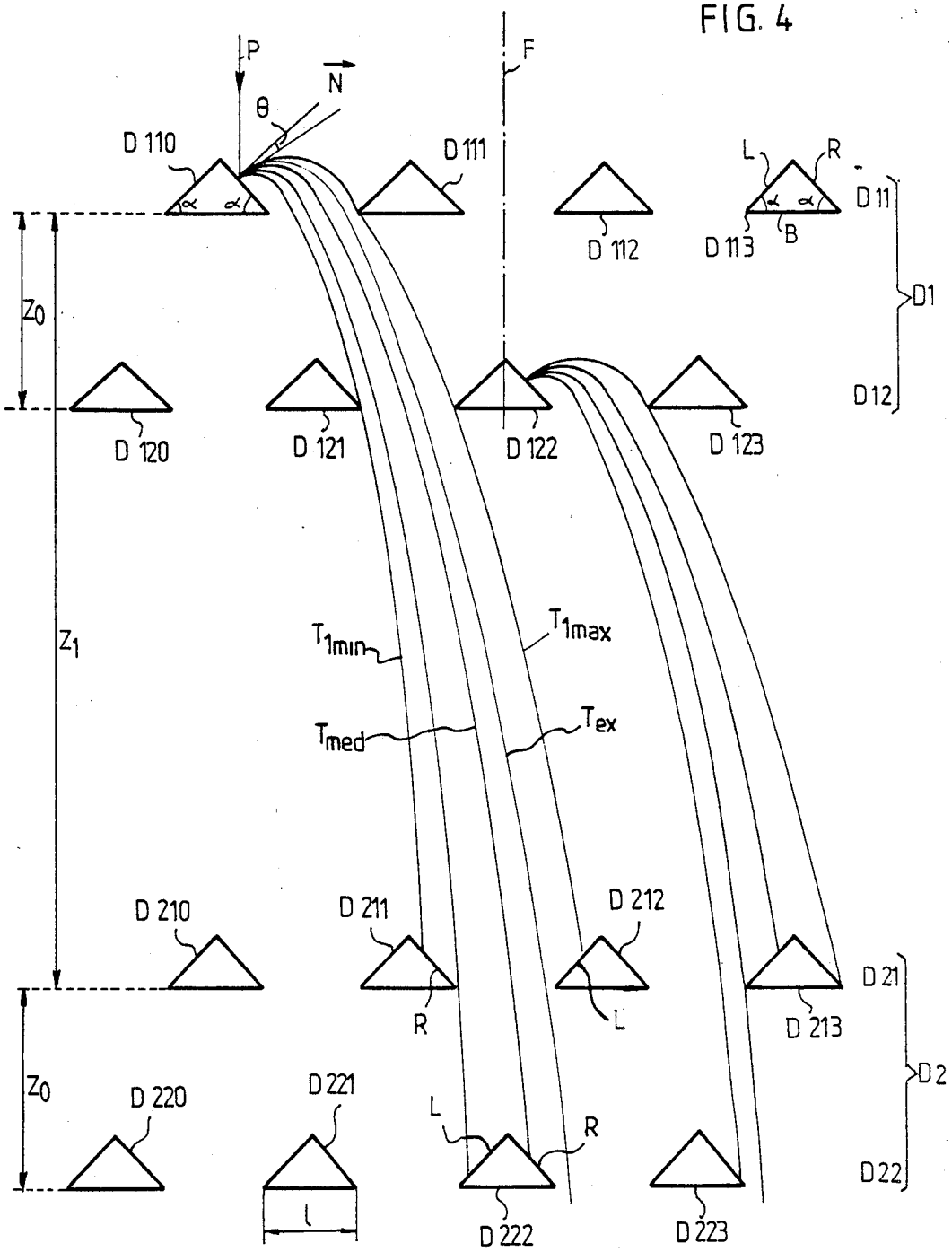
FIG. 4 is a diagram showing a portion of two consecutive dynode stages in the photomultiplier of FIGS. 1 and 2.

FIG. 4 shows two consecutive dynode stages on a larger scale, and by way of example these are the stages $D_1$ and $D_2$. As mentioned above, the stage $D_1$ comprises two planes $D_{11}$ and $D_{12}$ of dynode elements. The stage $D_2$ also comprises two planes $D_{21}$ and $D_{22}$ of dynode elements.

Individually, each of these dynode elements is a prismatic or cylindrical lamination, which extends parallel to associated elements and lies in the same plane therewith. These laminations are suitably treated to possess the property of secondary electron emission on their faces looking towards the inlet window FE. In other words they generate secondary electrons when any photon or charged particle such as an electron arrives in the direction P. This direction P is parallel to or only slightly inclined relative to the general direction of the axis F along which the electric field inside the tube is approximately established.

It is currently considered that the best shape for a dynode element is a bar whose cross-section is in the form of an isosceles triangle. The base B adjacent to the two equal angles of the isosceles triangle is perpendicular to the general direction F. It faces downstream. The two equal sides L and R of the isosceles triangle are rendered capable of secondary electron emission and it can be seen that they are symmetrically disposed about the general direction of incidence P. The two equal angles $\alpha$ are advantageously in the range 40° to 70°. In the example shown, the laminations have a cross-section in the form of a right-angled isosceles triangle.

The "apparent width" of the laminations may be defined as being the overall width which they present perpendicularly to the direction F. In this case, this width is equal to the length of the base B of the right-angled isosceles triangle, and is about 0.5 mm. Adjacent edges of two laminations in the same dynode plane are likewise separated by 0.5 mm. Finally, the laminations of the second plane of a dynode stage, for example in the plane $D_{12}$ of the stage $D_1$, are disposed between the laminations of the preceding plane (i.e. the plane $D_{11}$). Thus, the assembly of dynode elements in the two planes of a single dynode stage appears as an obstacle or baffle for electron paths parallel to the direction F.

Further, $Z_0$ denotes the distance between the two planes of dynodes $D_{11}$ and $D_{12}$ in a single stage, which distance is measured along the direction F. $Z_1$ denotes the distance measured in the same manner between two consecutive dynode stages, i.e. in the example shown between the first plane $D_{11}$ of the first stage $D_1$ and the first plane $D_{12}$ of the second stage $D_2$. $Z_1$ is preferably about four times $Z_0$.

In a particular embodiment, $Z_0 = 1$ mm and $Z_{1=4}$ mm, such that the distance between two dynode stages is about eight to ten times the apparent width of the laminations constituting the individual dynode elements.

The trajectories of the secondary electrons leaving the right-hand flank of the lamination $D_{110}$ are now considered with reference to FIG. 4. N designates the normal to this straight flank at the point of departure of said electrons.

It is convenient to define the lower limit of the initial energy of the secondary emmissions, and also the lower limit of the emission angle taken in the trigonometrical direction from the normal N. This emission angle is naturally limited to useful secondary electrons, i.e. to electrons which are not recaptured by the same plane of laminations. It has been observed that the initial energy must be greater than about 5 electron-volts, and that the initial emission angle must be less than 45°, i.e. that useful secondary electrons occupy a cone whose angular aperture is 45° relative to the normal.

It has also been observed that the width of the laminations must then be no greater than 0.5 mm for an electric field of 500 volts/cm. This value of electric field corresponds to a voltage of 50 volts between the two planes $D_{11}$ and $D_{12}$ of the dynode $D_1$, given that $Z_0 = 1$ mm.

Above this limit an important fraction of the secondary electrons emitted by a lamination are recaptured by the original emitting surface because of the high electric field. The above considerations take account of the cosine law governing the angle of emission $\theta$ of a secondary electron relative to the normal N.

Further, the electrons are energy filtered by virtue of the presence of the adjacent lamination $D_{111}$. It has been observed that the maximum energy of the secondary electrons which effectively leave the lamination $D_{110}$ is established at a few tens of electron-volts, and in the particular example shown at about 15 electron-volts.

For a given angle of emission, e.g. $\theta = 0°$, there are thus a minimum energy trajectory $T_{1min}$ and a maximum energy $T_{1max}$ which correspond respectively to 5 electron-volts and 15 electron-volts. In practice, these trajectories strike only two of the laminations $D_{211}$ and $D_{212}$ which constitute a portion of the first plane $D_{21}$ of the following dynode stage $D_2$. Trajectories having energies close to these extreme values strike the said extreme laminations. However, a portion of the trajectories having intermediate energy pass between the laminations $D_{211}$ and $D_{212}$ and strike, in a substantially symmetrical manner, the two flanks of the in-between lamination $D_{222}$ which constitutes a part of the second plane $D_{222}$ of the diode stage $D_2$. An intermediate trajectory is marked $T_{med}$ and corresponds to an energy of about 10 electron-volts. Careful observation shows that there exist trajectories $T_{ex}$ which pass between the laminations $D_{212}$ and $D_{222}$. However, such trajectories constitute only a very small fraction (in probability terms) of the emitted secondary electrons. A secondary electron propagating along such a trajectory will, in any case, be captured by the next dynode stage. Further, the edge effects due in the electric field due to the sharp edges of the laminations $D_{212}$ and $D_{222}$ serve to capture such escaping electrons, for the most part. In which case electrons following such escape trajectories nearly all generate secondary electrons at the dynode $D_2$ just like the electrons following trajectories to strike the three laminations $D_{211}$, $D_{212}$ and $D_{222}$.

The above description concerns secondary electrons emitted from the first plane of the first dynode stage, but it has been observed that the second plane offers similar localization possibilities (see FIG. 4).

The above-described operating conditions only concern the projection of electron trajectories on the X-Z plane. However, it has been observed that proper localization is obtained not only in the X direction, but also in the Y direction.

The above description shows that:

the distance $Z_1$ between two consecutive dynode stages which is large relative to the distance $Z_0$ between the two planes of a single stage may be adjusted as a function of the electric field so that secondary electrons from an upstream stage $D_1$ strike a small number of the laminations of the downstream stage $D_2$ in a concentrated distribution;

further, when the laminations used are symmetrical about the axis F (as is the present case) it has been observed that the distance $Z_1$ may be chosen such that the secondary electrons from the first plane of the upstream stage strike the flanks of the laminations of the downstream stage which are also symmetrically inclined in a manner which is substantially in balance. The same applies to the secondary electrons coming from the second plane or the upstream stage.

Figure 5:
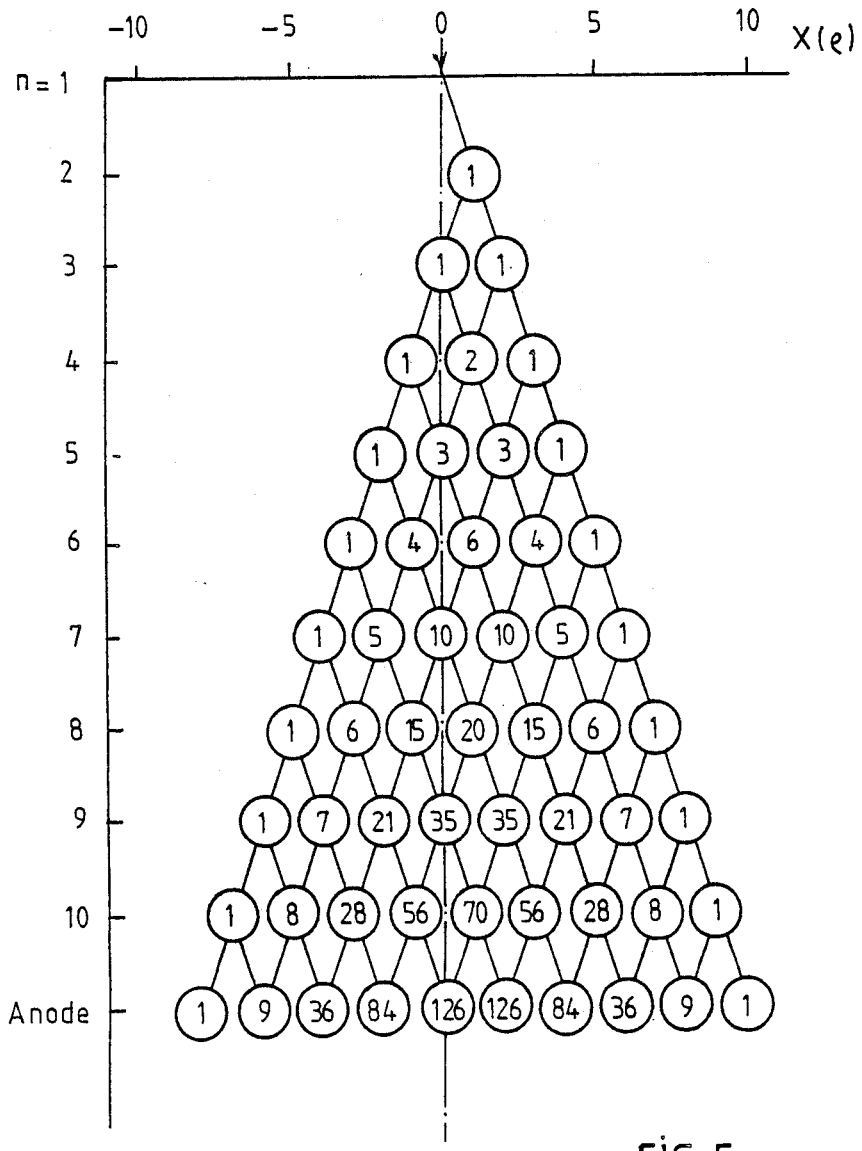
FIG. 5 is a diagram for use in interpreting the spatial resolution in an X direction perpendicular to the long direction of the laminations.

Further, it has been observed that the distribution in the Y direction parallel to the long dimension of the laminations is interpreted by a simple convolution of the lateral paths of the secondary electrons at each of the upstream stages. Reference is now made to FIG. 5.

This figure shows a binomial probability distribution characterized by $p = q$, where p and q are the probabilities that a secondary electron will strike the right flank or the left flank respectively of the laminations in the following stage. The figures in the circles are proportional to the probability that secondary electrons will be produced thereat starting from a single electron at the first dynode stage ($n = 1$), with the subsequent stages being numbered in increasing order down the vertical axis to the anode. The horizontal axis corresponds to distance expressed in units of the average lateral path of the secondary electrons between stages. These distances are marked $X(\rho)$.

It thus appears that in the X direction a highly concentrated distribution of secondary electrons is obtained, and that this distribution is substantially centered on the initial axis $F_0$. The shift away from this axis is principally due to the inclination of the flank of the lamination which gave rise to the first secondary electron. However, it is observed that there is no subsequent systematic drift in the flux of secondary electrons relative to the axis $F_0$, which drift would be amplified from one stage to the next (provided $p=q$). As a result there is a small lateral offset since the circled number 126 on the left is on the axis $F_0$ of FIG. 5, while the other circled number 126 is to the right thereof, thus corresponding to an overall shift in the distribution. It has been observed that the shift may be corrected by causing the values of p and q to vary by about 10%. This may be obtained by acting on the distance $Z_1$ as will be understood by the person skilled in the art. However, this action acts in the same manner regardless of the inclination of the face or flank of the lamination which produced the initial secondary electron.

The average lateral path $\rho$ (E, Z) of the secondary electrons plays an essential role in this device. It turns out that the geometry of the dynodes may be defined on the basis of this parameter, for example:

the width of the laminations l is chosen in such a manner that $\rho$ (E, $Z=l/2$) is greater than $l/2$ (for high gain), but that $\rho$ (E, $Z=Z_1$) is as small as possible (for good localization); and the distance $Z_1$ is likewise chosen as a compromise between resolution, $\rho$ (E, $Z=Z_1$) and the width of the electron distribution which is also proportional to $\rho$, and which must be large enough relative to l to avoid systematic X drift.

A photomultiplier device constituted as described above may be housed in a tube constituted as follows:

height about 65 mm;

outside diameter 134 mm;

diameter of inlet window 100 mm, said window being provided with a proximity photocathode;

dynode stages as described above with a potential difference of about 50 volts between two planes in a single dynode stage and a potential difference of about 200 volts between two dynode stages;

anode divided into 164 elements of about $7\times7$ mm$^2$, separated by gaps of about 0.5 mm; and the resulting gain is $10^6$ to $10^7$ for ten dynode stages.

The resulting resolution is about 12 mm in the X direction across the long dimension of the laminations and about 10 mm in the Y direction, parallel to the long dimension of the laminations. It turns out that substantially the same resolution is obtained in both the X and the Y directions even though the structure of a plane of laminations is not at all isotropic.

In order to further equalize the X and the Y resolution, it is possible to cross the long directions of the laminations in successive dynode stages. Optimum space resolution can readily be obtained by adjusting the high tension which acts on the electric field overall, or even by finer action on the electric field between successive stages and between the planes of a given dynode.

A photomultiplier obtained obtained in this way has a very large active surface area and its sensitivity may be comparable to that of the prior art device. Spatial resolution may be further improved by reducing the size l of the dynode laminations, and by correspondingly reducing the electric field and the vertical dimensions (or the longitudinal dimension) of the device.

Such resolution characteristics are adequate for many applications. They are particularly suitable for applications concerned with X-ray and $\gamma$-ray imaging.

For example, when imaging $\gamma$-rays using an Anger type camera, constituted by a crystal of sodium iodide which is 10 mm thick and a network of 2-inch photomultipliers as a detector directly coupled to the crystal, the spatial resolution obtained after calculating the barycenter is no better than about 4 mm. Under such conditions, it is observed that the spatial resolution is dominated by the resolution of the detector which is about 50 mm and which is too small relative to the spot size of the scintillation beams which is about the thickness of the crystal, i.e. 20 mm.

In such a case, even limited detector resolution may improve the final resolution by an important factor. For example, using a photodetector resolution of 10 mm a final resolution of 1.6 mm may be obtained.

This can readily be achieved using the photomultiplier device described in detail above.

Finally, it may be observed that excellent properties are obtained using an electron multiplier in accordance with the invention concerning response time and linearity of gain, in addition to the above-mentioned spatial resolution.

I claim:

1. An electron multiplier device comprising, in a vacuum tube, a succession of plane parallel electrodes defining a plurality of dynode stages capable of secondary electron emission, said dynode stages being disposed between an inlet window and an outlet anode, and the device further including means connected to said electrodes in order to establish an electron-accelerating electric field therebetween, with the general direction of said field being perpendicular to the electrodes, wherein each dynode stage is defined on two successive planes, each of which is constituted by interconnected parallel laminations, with the laminations in the two planes of a single dynode stage being offset relative to each other in such a manner that said two planes together constitute an obstacle or baffle for electron trajectories which are perpendicular thereto, and wherein each dynode stage is disposed in such a manner that the majority of secondary electrons effectively leaving a lamination of its first plane do not strike a lamination of its second plane, the distance $Z_1$ between two consecutive dynode stages being large relative to the distance $Z_0$ between the two planes of a single stage, and being chosen as a function of the electric field in such a manner that the secondary electrons from an upstream stage strike a reduced number of laminations in the downstream stage in a concentrated distribution.

2. A device according to claim 1, wherein the laminations are prismatic or cylindrical, having a cross-section which projects towards the inlet window giving rise to two flanks capable of secondary electron emission and substantially symmetrically disposed about the general direction S of the electric field, and wherein the distance $Z_1$ between dynode stages is chosen in such a manner that the secondary electrons from an upstream stage strike the symmetrically inclined flanks of the laminations of the downstream stage in a substantially balanced manner.

3. A device according to claim 2, wherein the cross-section of the laminations is substantially in the form of an isosceles triangle in which the two equal angles lie in the range 40° to 70°.

4. A device according to claim 2, wherein the distance $Z_1$ between consecutive dynode stages is chosen to slightly unbalance the inpact symmetry on the downstream stage of secondary electrons coming from the upstream stage, thereby avoiding shifting spatial localization due to the inclination of the flanks.

5. A device according to claim 1, wherein the apparent width of the laminations is not greater than about 0.5 mm.

6. A device according to claim 1, wherein the average electric field is not less than about 500 V/cm.

7. A device according to claim 1, wherein the initial energy of the effectively emitted secondary electrons is not less than about 5 electron-volts.

8. A device according to claim 7, wherein the initial energy of the effectively emitted secondary electrons is limited to not more than a few tens of electron-volts.

9. A device according to claim 1, wherein at least two consecutive dynode stages have their laminations oriented in different directions, and preferably perpendicular directions.

10. A device according to claim 1, wherein the voltage between the two planes of a single dynode stage is not more than 50 volts, at least in the initial stages, thereby enabling good detection of an isolated photoelectron.

11. A device according to claim 1, wherein means are provided for adjusting the voltage supplied to the electrodes in order to optimize resolution.

12. A device according to claim 1, and including a cathode or photocathode in the proximity of the first dynode.

13. A device according to claim 1, including an anode which is a multiply-connected divided anode, an electroluminescent surface, or a resistive anode.

14. A device according to claim 3, wherein the distance $Z_1$ between consecutive dynode stages is chosen to slightly unbalance the impact symmetry on the downstream stage of secondary electrons coming from the upstream stage, thereby avoiding shifting spatial localization due to the inclination of the flanks.

* * * * *